US007965240B2

(12) United States Patent
Moon et al.

(10) Patent No.: US 7,965,240 B2
(45) Date of Patent: Jun. 21, 2011

(54) DUAL-BAND PLANAR INVERTED-F ANTENNA

(75) Inventors: Young-min Moon, Seoul (KR); Young-eil Kim, Suwon-Si (KR); Gyoo-soo Chae, Cheonan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/764,562

(22) Filed: Apr. 21, 2010

(65) Prior Publication Data

US 2010/0201581 A1 Aug. 12, 2010

Related U.S. Application Data

(63) Continuation of application No. 11/347,217, filed on Feb. 6, 2006, now Pat. No. 7,733,271.

(30) Foreign Application Priority Data

Feb. 4, 2005 (KR) ..... 10-2005-0010759

(51) Int. Cl.
*H01Q 1/38* (2006.01)

(52) U.S. Cl. ..... 343/700 MS; 343/702

(58) Field of Classification Search ..... None
See application file for complete search history.

(56) References Cited

U.S. PATENT DOCUMENTS

| | | | | |
|---|---|---|---|---|
| 4,742,359 | A | 5/1988 | Ishino et al. | |
| 5,966,097 | A | 10/1999 | Fukasawa et al. | |
| 6,707,428 | B2 | 3/2004 | Gram | |
| 6,795,028 | B2 | 9/2004 | Stutzman et al. | |
| 7,026,996 | B2 | 4/2006 | Harano | |
| 7,026,999 | B2 | 4/2006 | Umehara et al. | |
| 7,084,813 | B2 | 8/2006 | Pathak et al. | |
| 7,136,022 | B2 * | 11/2006 | Sato et al. | 343/702 |
| 7,173,567 | B2 | 2/2007 | Inatsugu et al. | |
| 7,215,289 | B2 | 5/2007 | Harano | |
| 7,733,271 | B2 * | 6/2010 | Moon et al. | 343/700 MS |
| 2003/0169209 | A1 | 9/2003 | Ohara et al. | |

(Continued)

FOREIGN PATENT DOCUMENTS

| | | |
|---|---|---|
| JP | 61232704 | 10/1986 |

(Continued)

OTHER PUBLICATIONS

"Antenna Frequency Scaling" from "The ARRL Antenna Book", Published by the American Radio Relay League, Copyright @ 1988, p. 2-24 to 2-25.

*Primary Examiner* — Trinh V Dinh
(74) *Attorney, Agent, or Firm* — Sughrue Mion, PLLC

(57) ABSTRACT

An improved and more compact structure of a built-in antenna for handheld terminals, improving radiation pattern and efficiency. Provided is a planar inverted-F antenna having a radiation part having an inductive radiation portion and a parasitic radiation portion which are spaced in a certain distance apart from a ground surface, a power-supply part horizontally spaced apart from the ground surface and for directly supplying currents to the connected inductive radiation portion, and connection parts for connecting the radiation portions to the ground. The planar inverted-F antenna has an inductive antenna portion and a parasitic antenna portion, thereby reducing its volume compared to the conventional inverted-F antenna. Complicated manufacturing and processing procedures are simplified by connecting the power-supplying part and a PCB.

4 Claims, 7 Drawing Sheets

U.S. PATENT DOCUMENTS

| | | | | |
|---|---|---|---|---|
| 2004/0108957 | A1* | 6/2004 | Umehara et al. | 343/700 MS |
| 2005/0168384 | A1* | 8/2005 | Wang et al. | 343/700 MS |
| 2005/0285596 | A1 | 12/2005 | Suzuki et al. | |
| 2006/0022889 | A1 | 2/2006 | Chiang et al. | |
| 2007/0057849 | A1 | 3/2007 | Moon et al. | |
| 2007/0069958 | A1 | 3/2007 | Ozkar | |
| 2008/0168384 | A1 | 7/2008 | Platzer et al. | |

FOREIGN PATENT DOCUMENTS

| | | | |
|---|---|---|---|
| JP | 01231404 | | 9/1989 |
| JP | 03228407 | | 10/1991 |
| JP | 07022832 | | 1/1995 |
| JP | 2004-201278 | A | 7/2004 |
| WO | 0182412 | A2 | 11/2002 |
| WO | 2004/025778 | A1 | 3/2004 |

* cited by examiner

DUAL-BAND PLANAR INVERTED-F ANTENNA

CROSS-REFERENCE OF RELATED APPLICATIONS

This application is a Continuation Application of U.S. application Ser. No. 11/347,217 filed Feb. 6, 2006, now U.S. Pat. No. 7,733,271, which claims priority from Korean Patent Application No. 10-2005-0010759, filed on Feb. 4, 2005 in the Korean Intellectual Property Office, the entire contents of which are incorporated herein by reference.

BACKGROUND OF THE INVENTION

1. Field of the Invention

The present invention relates to a built-in antenna for handheld terminals, and more particularly to a structure of a built-in antenna for handheld terminals configured for efficient use of the internal space of the handheld terminals and for improvement of antenna radiation pattern and efficiency.

2. Description of the Related Art

Handheld terminals such as cellular phones, PDAs, or the like refer to devices enabling users to send and receive data while moving.

There are external antennas as antennas used for the conventional handheld terminals. Such external antennas are placed in an exterior space of a handheld terminal, and classified into mono-pole antennas, helical antennas, and the like.

Such mono-pole antennas are formed of a conductive pole, the antenna length of which is determined based on a frequency domain. Accordingly, such mono-pole antennas have a disadvantage in that the length of the antennas becomes longer than the handheld terminals as the handheld terminals are getting smaller. Further, such mono-pole antennas have a disadvantage of being damaged due to external shocks.

Such helical antennas are formed of a conductive coil wound on a conductive plate. Such helical antennas have an advantage of being structured short compared to the mono-pole antennas, but have a disadvantage of being damaged due to external shocks. Further, since such an external antenna is placed near the head of a user when the user uses a handheld terminal, electromagnetic waves can have adverse influence on the user. In order to eliminate such disadvantages of the external antennas, an inverted-F antenna (IFA) has been proposed.

FIG. 1 is a cross-sectional view for showing a conventional general inverted-F antenna, and FIG. 2 is a perspective view for showing the same. In FIGS. 1 and 2, the inverted-F antenna is configured in a three-dimensional form with a ground part 100, a radiation part 102, a connection part 104, and a power-supply part 106. Hereinafter, description will be made on the inverted-F antenna.

The radiation part 102 is disposed on the upper portion of the ground part 100, and the connection part 104 connects the ground part 100 and the radiation part 102, and is disposed on the end portion of the radiation part 102. The power-supply part 106 provides currents to the radiation part 102. Generally, impedance matching is determined based on the location of the power-supply part 106 and the length of the connection part 104.

As discussed above, an inverted-F antenna is a built-in antenna so that it can be built in a handheld terminal, thereby considerably solving the disadvantages of an external antenna. In addition, the inverted-F antenna has an advantage of easy production compared with an external antenna.

However, the inverted-F antenna has a problem of having a limitation of maximum compactness and lightness in aspect of the size and the interval between the radiation part and the ground part in light of the trend that the handheld terminals are becoming more compact and lighter. Further, the conventional handheld terminals have a disadvantage of a complicated manufacture and production process due to the structures of the ground part and the power-supply part.

SUMMARY OF THE INVENTION

The present invention has been developed in order to address the above drawbacks and other problems associated with the conventional arrangement. An aspect of the present invention is to provide a more compact and improved structure of a built-in antenna for handheld terminals capable of improving antenna radiation patterns and efficiency at the same time.

The foregoing and other aspects are substantially realized by providing an inverted-F antenna, comprising a radiation part having an inductive radiation portion and a parasitic radiation portion which are spaced in a certain distance apart from a ground surface; a power-supply part horizontally spaced apart from the ground surface, and for directly supplying currents to the connected inductive radiation portion; and connection parts for connecting the radiation portions to the ground.

In an exemplary embodiment, the inductive radiation portion is formed in a shape of "⌐", and the parasitic radiation portion is formed in a shape of "¬".

Further, the inductive radiation portion may be approximately 3 mm, spaced apart from the ground surface.

Further, the parasitic radiation portion may be approximately 5 mm, spaced apart from the ground surface.

Further, the connection part of the inductive radiation portion may be approximately 24 mm, spaced apart from the connection part of the parasitic radiation portion, and a length of the inductive radiation portion may be approximately 18 mm, and a length of the parasitic radiator may be approximately 19 mm.

Further, the radiation portions may cause resonance in two frequency bands.

Further, the inductive radiation portions may cause resonance in a high-frequency band, and the inductive radiation portion and the parasitic radiation portion cause resonance in a low-frequency band.

Further, the high-frequency band may be approximately 5.4 GHz, and the low-frequency band is approximately 2.4 GHz.

Further, the inductive radiation portion and the parasitic radiation portion may be formed in a folded shape.

Further, the inductive radiation portion may be spaced apart from the parasitic radiation portion.

Further, a length of the inductive radiation portion may be approximately 7 mm, and a length of the parasitic radiation portion may be approximately 8 mm.

Further, the inductive radiation portion may be approximately 4 mm, and the parasitic radiation portion may be approximately 1.5 mm, spaced apart from the ground surface.

BRIEF DESCRIPTION OF THE DRAWINGS

The above aspects and features of the present invention will be more apparent by describing certain exemplary embodiments of the present invention with reference to the accompanying drawings, in which.

DETAILED DESCRIPTION OF THE EXEMPLARY EMBODIMENTS

Hereafter, description will be made on exemplary embodiments of a planar inverted-F antenna proposed by the present invention, with reference to the accompanying drawings. That is, the present invention proposes a two-dimensional inverted-F antenna rather than a conventional three-dimensional inverted-F antenna. In addition, the present invention proposes a method of directly connecting a power-supply part to a PCB for easy manufacture or production.

Figure 3:
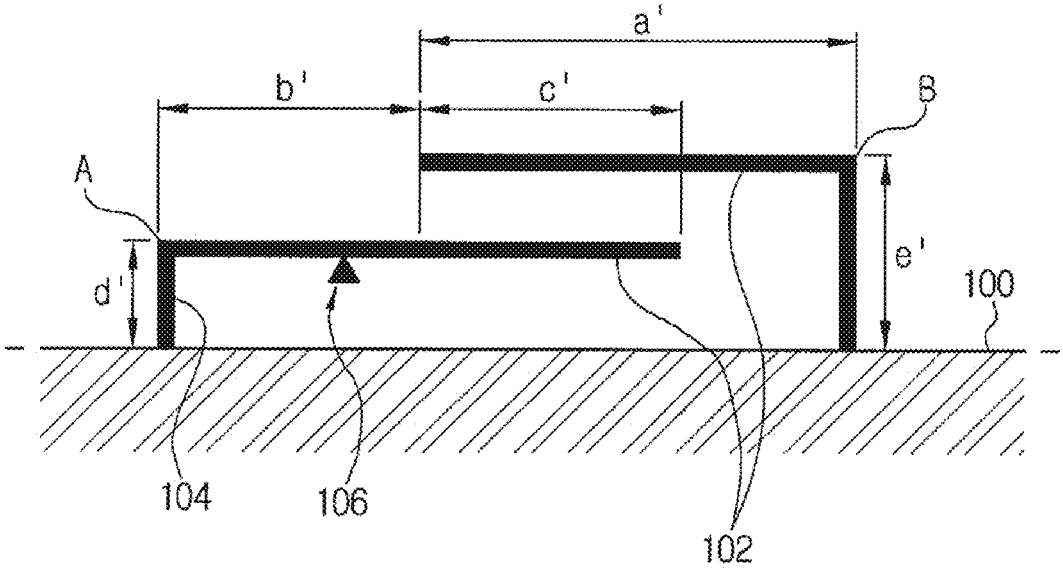
FIG. 3 is a view for showing a structure of a planar inverted-F antenna according to an exemplary embodiment of the present invention.

FIG. 3 shows a planar inverted-F antenna according to an exemplary embodiment of the present invention. In FIG. 3, a planar inverted-F antenna is constructed with a ground part 100, a radiation part 102, a connection part 104, and a power-supply part 106. In addition, the planar inverted-F antenna shown in FIG. 3 has an inductive antenna portion A including an inductive radiation portion, and a parasitic antenna portion B including a parasitic radiation portion. The parasitic antenna portion is used to accomplish the increase of a bandwidth and the implementation of a dual band at the same time.

In FIG. 3, the power-supply part 106 is not connected to the ground part 100, but directly connected to the PCB. The inductive antenna portion connected to the power-supply part 106 is the same as that of a general planar inverted-F antenna.

Generally, the total length of an antenna is λ/4. Accordingly, the lower the operating frequency is, the longer the length of an antenna becomes. The Equation 1 below shows the length of an antenna at an operating frequency.

$$L=\lambda/4=v/4f, \quad \text{[Equation 1]}$$

in here, L denotes the length of an antenna, λ a wavelength of a radio wave, v the speed of the radio wave, and f the frequency of the radio wave. As expressed in Equation 1, an operating frequency is inversely proportional to the length of an antenna, so that the lower the frequency becomes, the longer the length of an antenna becomes.

In FIG. 3, the parasitic antenna portion brings out the effect of prolonging the length of an antenna. Accordingly, in order to implement the total length of λ/4 of an antenna, a planar inverted-F antenna is manufactured to have the length of λ/8 for the inductive antenna portion and the length of λ/8 for the parasitic antenna portion. <Table 1> shows the lengths of the respective portions of a planar inverted-F antenna as an example.

TABLE 1

| Portions of a planar inverted-F antenna | Lengths(mm) |
|---|---|
| a' | 19 |
| b' | 5 |
| c' | 13 |
| d' | 3 |
| e' | 5 |

Figure 1:
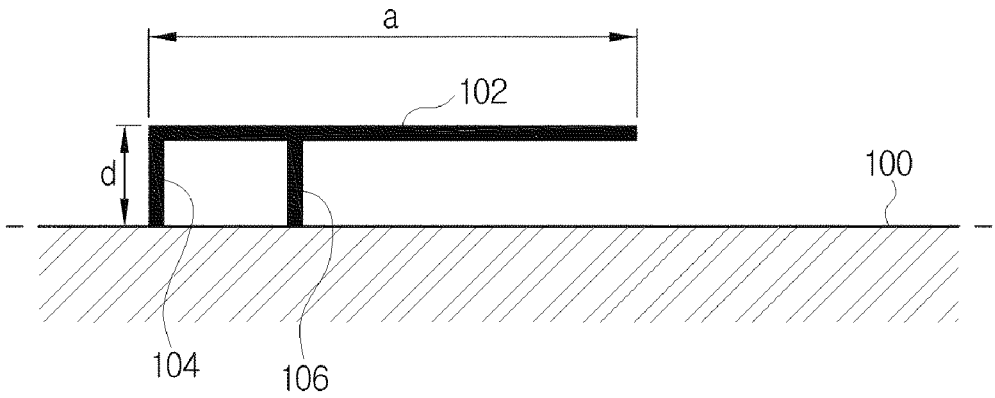
FIG. 1 (PRIOR ART)
FIG. 1 is a cross-sectional view for showing a conventional general three-dimensional inverted-F antenna.
Figure 2:
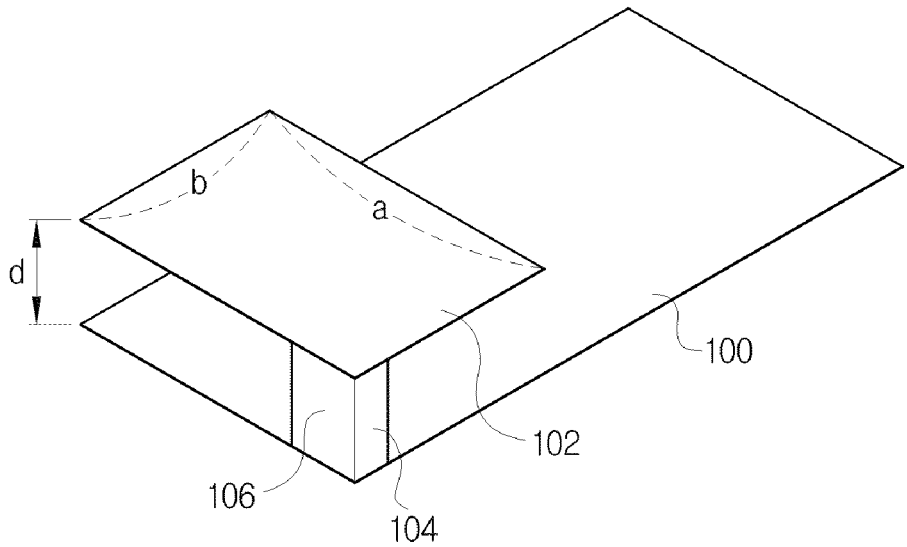
FIG. 2 (PRIOR ART)
FIG. 2 is a perspective view for showing a conventional general three-dimensional inverted-F antenna.

As in <Table 1>, the length of the planar inverted-F antenna proposed by the invention is shortened compared with that of the three-dimensional inverted-F antenna shown in FIG. 2. That is, at the frequency of 2.4 GHz, a' and b' of the inverted-F antenna shown in FIG. 2 are approximately 30 mm each, and d of the same is approximately 6 mm. However, it can be seen that the volume of the antenna decreases as shown in <Table 1> even though the operating frequency of the planar inversed-F antenna is around 2 GHz (2.4 GHz) or 5 GHz (5.4 GHz).

Figure 4:
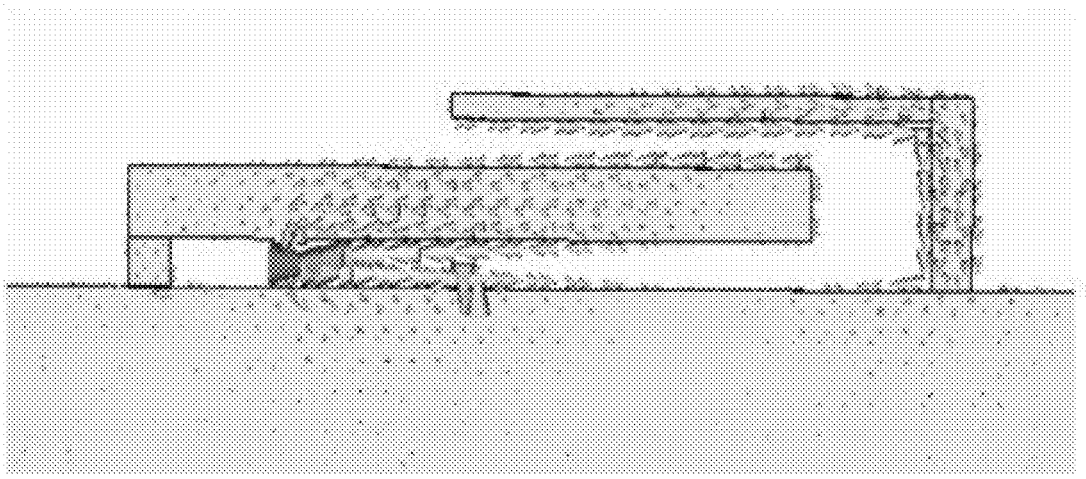
FIG. 4 is a view for showing a high-frequency resonance of a planar inverted-F antenna according to an exemplary embodiment of the present invention.
Figure 5:
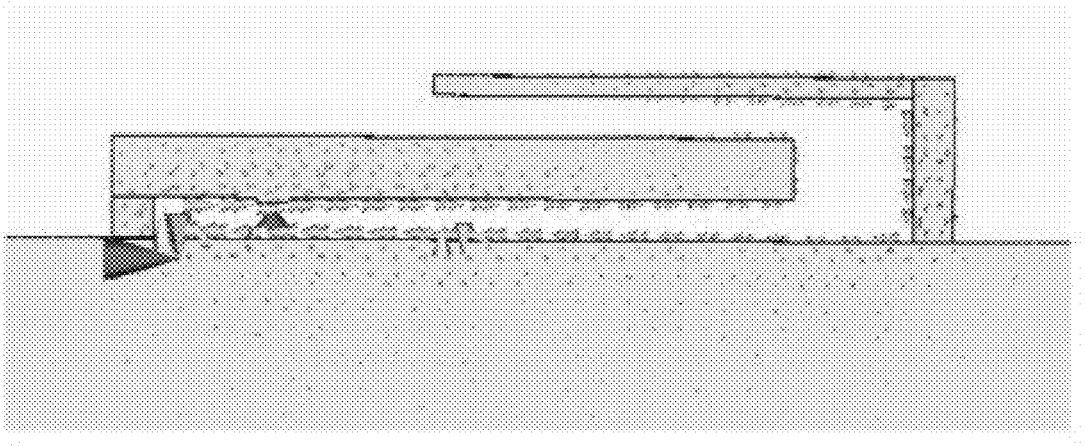
FIG. 5 is a view for showing a low-frequency resonance of a planar inverted-F antenna according to an exemplary embodiment of the present invention.

Further, the inductive antenna portion connected to the power-supply part 106 forms a high-frequency resonance as shown in FIG. 4, and the extended inductive antenna portion and the parasitic antenna portion form a low-frequency resonance as shown in FIG. 5, so that the dual-band proposed by the invention is implemented.

Figure 6:
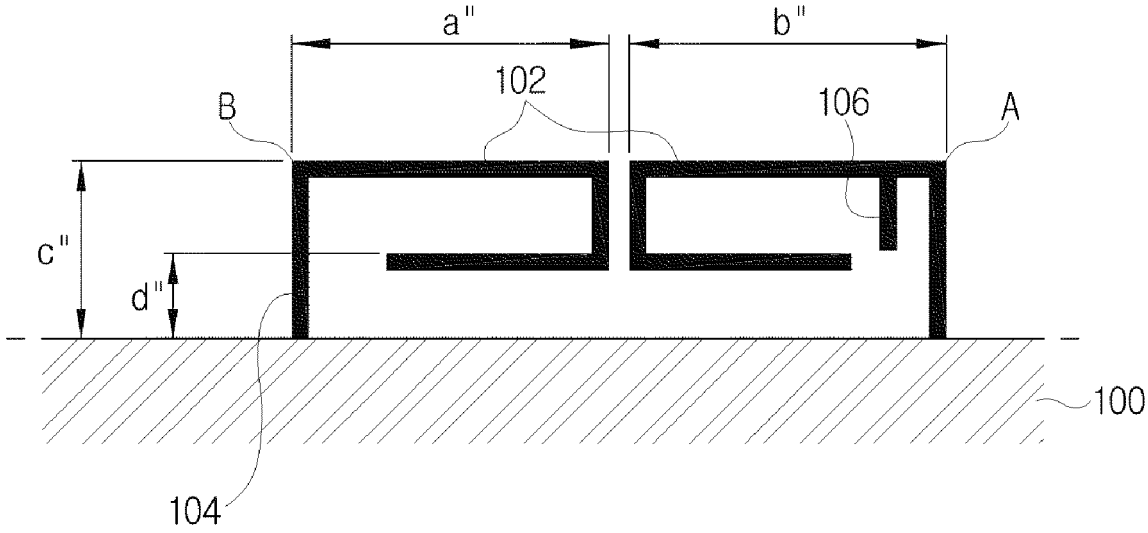
FIG. 6 is another view for showing a structure of a planar inverted-F antenna according to an exemplary embodiment of the present invention.

FIG. 6 shows another structure of a planar inverted-F antenna according to an exemplary embodiment of the present invention. In FIG. 6, a planar inverted-F antenna is built with a ground part 100, a radiation part 102, a connection part 104, and a power-supply part 106. Further, the planar inverted-F antenna proposed in FIG. 6 has an inductive antenna portion A and a parasitic antenna portion B. The parasitic antenna portion is used to accomplish the increase of a bandwidth and the implementation of a dual band at the same time. In addition, different from FIG. 3, the radiation part 102 of the inductive antenna portion is formed in a shape of "ε" together with the radiation part 102 of the parasitic antenna portion for shorter length.

In FIG. 6, the power-supply part 106 is not connected to the ground part 100, but directly connected to the PCB.

Generally, since the total length of an antenna is λ/4, the parasitic antenna portion brings out the effect of prolonging the length of an antenna. Accordingly, the total length of the inductive antenna portion is λ/8, and the length of the parasitic antenna portion is also λ/8. However, since the radiation part 102 is formed in the shape of "ε" with the inductive antenna portion and the parasitic antenna portion, the actual length of the antenna is further reduced. <Table 2> shows the lengths of the respective portions of a planar inverted-F antenna as an example.

TABLE 2

| Portions of a planar inverted-F antenna | Lengths(mm) |
|---|---|
| a" | 8 |
| b" | 7 |
| c" | 4 |
| d" | 1.5 |

As shown in <Table 2>, the length of the planar inverted-F antenna proposed by the present invention is shortened compared with the length of the three-dimensional inverted-F antenna shown in FIG. 2. Especially, <Table 2> exemplarily shows when the operating frequency of a planar inverted-F antenna is around 2 GHz (2.4 GHz) or 5 GHz (5.4 GHz). Further, the gap of 0.2 mm is formed between the radiation part 102 of the inductive antenna portion and the radiation part 102 of the parasitic antenna portion, which facilitates the coupling of the inductive antenna portion with the parasitic antenna portion.

Figure 7:
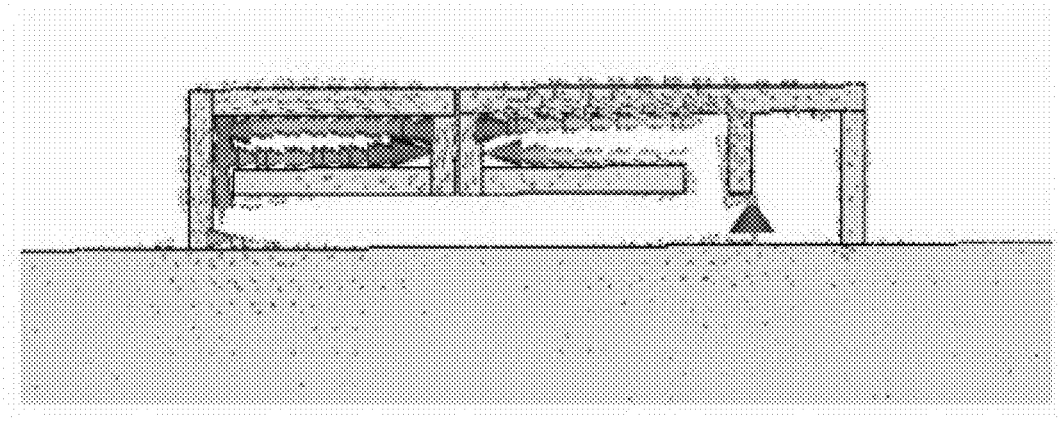
FIG. 7 is another view for showing a high-frequency resonance of a planar inverted-F antenna according to an exemplary embodiment of the present invention.
Figure 8:
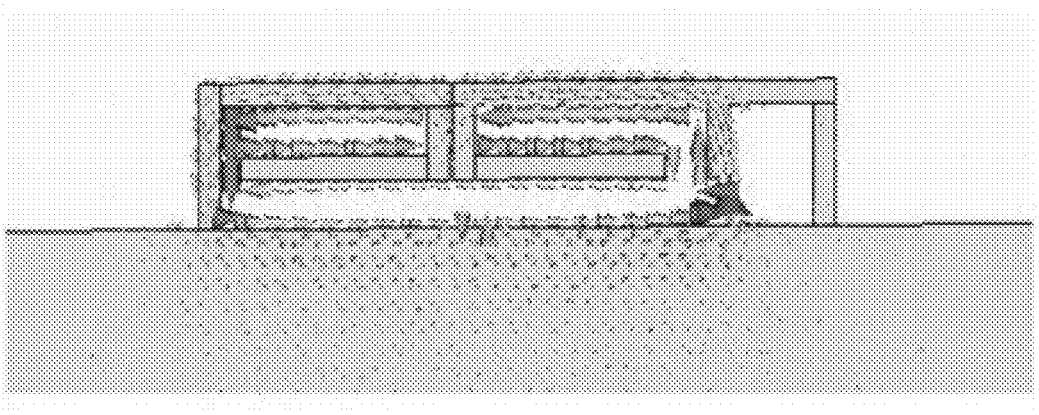
FIG. 8 is another view for showing a low-frequency resonance of a planar inverted-F antenna according to an exemplary embodiment of the present invention.

The dual band proposed by the invention is implemented as below. The radiation part 102 is in a shape of "。", and the inductive antenna portion connected to the power-supply part forms a high-frequency (around 5 GHz) resonance as shown in FIG. 7, and the extended inductive antenna portion and the parasitic antenna portion form a low-frequency resonance (around 2 GHz) as shown in FIG. 8.

Figure 9:
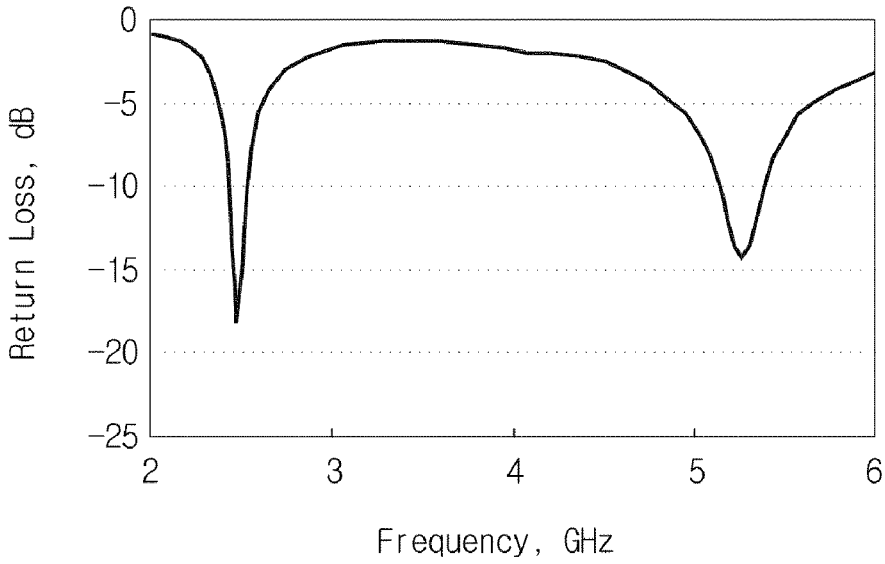
FIG. 9 is a view for showing losses at operating frequencies of the planar inverted-F antenna shown in FIG. 3.
Figure 10:
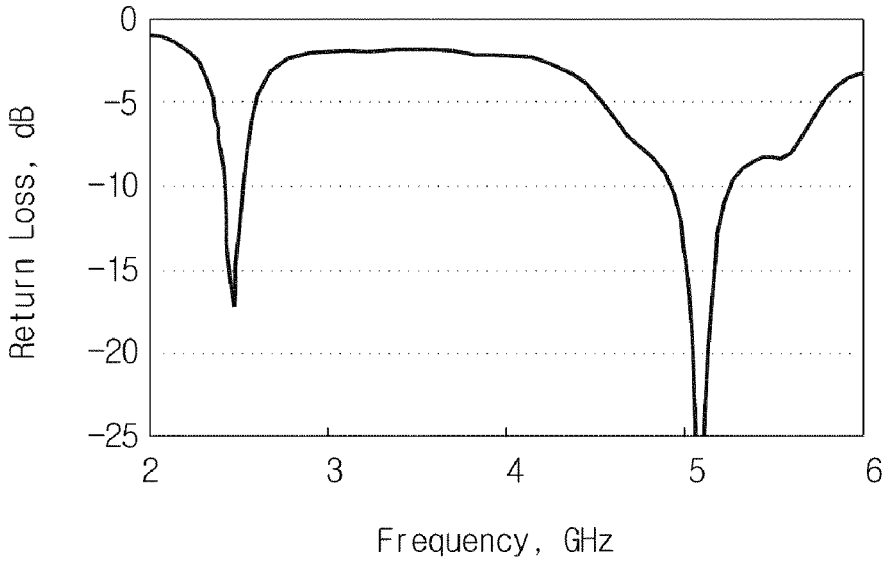
FIG. 10 is a view for showing losses at operating frequencies of the planar inverted-F antenna shown in FIG. 6.

FIG. 9 is a view for showing the losses at operating frequencies of the planar inverted-F antenna proposed in FIG. 3, and FIG. 10 is a view for showing the losses at operating frequencies of the planar inverted-F antenna proposed in FIG. 6. In FIGS. 9 and 10, it can be seen that the losses drastically occur at the frequencies around 2 GHz and 5 GHz. Therefore, the planar inverted-F antenna proposed by the invention can be used for a dual band.

Figure 11:
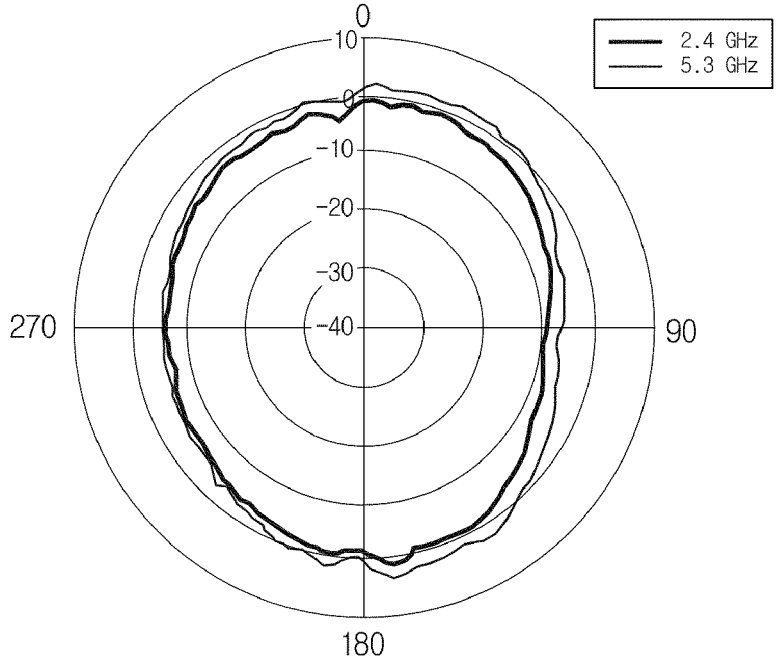
FIG. 11 is a view for showing the radiation pattern of the planar inverted-F antenna shown in FIG. 3.
Figure 12:
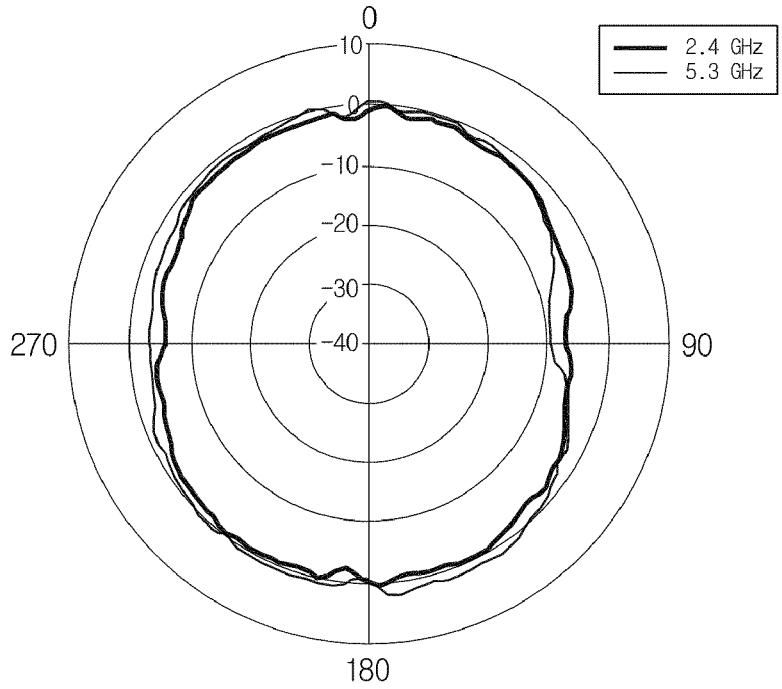
FIG. 12 is a view for showing the radiation pattern of the planar inverted-F antenna shown in FIG. 6.

FIG. 11 is a view for showing the radiation pattern of the planar inverted-F antenna proposed in FIG. 3, and FIG. 12 is a view for showing the radiation pattern of the planar inverted-F antenna proposed in FIG. 6. As shown in FIGS. 11 and 12, it can be seen that the planar inverted-F antenna proposed in the invention has uniform radiation patterns at the frequencies around 2 GHz and 5 GHz.

As described above, the present invention proposes the planar inverted-F antenna having an inductive antenna portion and a parasitic antenna portion, reducing its volume compared with a conventional inverted-F antenna. Further, the inductive antenna portion and the parasitic antenna portion are combined in use, which enables the antenna to be used in two frequency bands. Furthermore, exemplary embodiments of the present invention connects the power-supply part to the PCB, thereby simply implementing complicated manufacturing and processing procedures.

The foregoing embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An inverted-F antenna, comprising:

a radiation part having an inductive radiation portion and a parasitic radiation portion which are spaced in a certain distance apart from a ground surface;

a power-supply part horizontally spaced apart from the ground surface, and for directly supplying currents to the inductive radiation portion which is connected to the power-supply part; and connection parts for connecting the inductive radiation portion and the parasitic radiation portion to the ground surface;

wherein the ground surface, the inductive radiation portion and the parasitic radiation portion are arranged on a same plane, wherein the parasitic radiation portion is used for implementation of a dual band, and wherein the inductive radiation portion comprises:

a first strip comprising a first end vertically connected to a side of the ground surface;

a second strip comprising one end connected to the other end of the first strip and disposed horizontal to the ground surface;

a third strip comprising one end connected to the other end of the second strip and disposed vertical to the ground surface; and a fourth strip comprising one end connected to the other end of the third strip and the other end open and disposed horizontal to the ground surface, and wherein the power supply part is connected to the second strip.

2. The antenna as claimed in claim 1, wherein the inductive radiation and the parasitic radiation portion are spaced approximately 0.2 mm apart from each other.

3. The antenna as claimed in claim 1, wherein the radiation part is formed in the shape of "。".

4. The antenna as claimed in claim 1, wherein the parasitic radiation portion comprises:

a first strip comprising a first end vertically connected to a side of the ground surface;

a second strip comprising one end connected to the other end of the first strip and disposed horizontal to the ground surface;

a third strip comprising one end connected to the other end of the second strip and disposed vertical to the ground surface; and a fourth strip comprising one end connected to the other end of the third strip and the other end open and disposed horizontal to the ground surface.

* * * * *